United States Patent [19]

Davis, II

[11] Patent Number: 4,908,732

[45] Date of Patent: Mar. 13, 1990

[54] ELECTRONIC SIREN INTERRUPT SYSTEM

[76] Inventor: Lavelle W. Davis, II, 12750 Beaubien Rd., Jacksonville, Fla. 32223

[21] Appl. No.: 95,629

[22] Filed: Sep. 14, 1987

[51] Int. Cl.[4] ..... H01N 47/00

[52] U.S. Cl. ..... 361/170; 307/116; 340/384 E

[58] Field of Search ..... 361/160, 170; 455/78, 455/89; 379/110; 307/11, 116, 112; 340/75, 88, 405, 384 R, 384 E

[56] References Cited

U.S. PATENT DOCUMENTS

| | | | |
|---|---|---|---|
| 3,262,096 | 7/1966 | Nunn, Jr. | 340/88 |
| 3,947,694 | 3/1976 | Carroll | 307/112 |
| 4,425,477 | 1/1984 | Magil | 379/110 |
| 4,646,063 | 2/1987 | Carson | 340/405 |

*Primary Examiner*—L. T. Hix
*Assistant Examiner*—David M. Gray

[57] ABSTRACT

A device for interrupting the siren signal when the transmit microphone is keyed on a radio communication and siren system. Keying the microphone energizes the coil of a relay, opening a first set of contacts which had formed a complete circuit from the siren signal output source to the siren speaker, so that during voice transmission over the microphone the siren signal is silenced. The siren signal is diverted through a second set of contacts into a set of resistors. Unkeying the microphone de-energizes the relay coil, opening the second set of contacts and closing the first set of contacts, thereby recreating the complete circuit to the speaker and allowing the speaker to emit the siren sound.

7 Claims, 2 Drawing Sheets

ELECTRONIC SIREN INTERRUPT SYSTEM

BACKGROUND OF THE INVENTION

Electronic communication and siren systems are well known, perhaps the most prevalent use being in law enforcement vehicles. The officer must have the ability to alert the general public of his presence during high speed maneuvers and this is commonly performed by sounding a loud siren over a public address speaker amounted on the vehicle. It is also necessary for the officer to be able to communicate via a radio system with the control dispatcher or other officers. The common system in use involves a hand-held microphone. When the officer wishes to transmit over the radio, he keys it by depressing a switch on the microphone, thus activating the microphone and allowing transmission. When he finishes his transmission, he unkeys the microphone, thereby allowing the radio to receive incoming transmissions.

It is almost always necessary for the officer to transmit over the radio during high speed pursuits or maneuvers, for example to relay his position or request assistance. It is also absolutely necessary that the loud siren be in operation as much as possible to alert pedestrians and other vehicles of his approach. This creates a serious problem with regard to communications, in that the officer's voice is often drowned out by the siren. This creates the need to have information repeated or risk the possibility of miscommunication.

BRIEF SUMMARY OF THE INVENTION

The invention is a combination of a small number of electronic components which is connected to existing output and input points on known electronic radio communication and siren systems commonly used, for example, on law enforcement vehicles. The invention is placed in an electronic circuit between the siren signal output terminals and the public address speaker input terminals. In the unactivated state, the siren signal proceeds through the invention to the speaker uninterrupted. When the invention is activated by the keying of the radio microphone transmission switch, the siren signal is interrupted so that no sound emits from the speaker. Upon release of the microphone switch, i.e., when the officer ceases transmission, the siren signal is immediately allowed to proceed to the speaker and sound emission resumes.

It is the general object of this invention to alleviate the problem of the siren during radio operation. It is a further object of this invention to provide a system whereby the siren is interrupted whenever the officer is transmitting over the radio microphone. It is a further object of this invention to provide a system which can be installed to existing communication/siren systems which involves reliable yet low-cost components. It is a further object of this invention to provide a system which does not create electronic interferences which may damage components in the existing communication/siren systems.

The major component of the invention is a standard relay, comprised of a coil and two sets of contact points. When unactivated, the siren signal proceeds from the output source, through the set of closed contacts and on to the speaker. When the microphone is keyed, the coil of the relay is energized, opening the first set of contacts and closing a second set of contacts which are not connected to the speaker. This in effect kills the siren until the time when the microphone is unkeyed, thereby de-energizing the coil and closing the first set of contacts, which allows the siren signal to again reach the speaker.

As will be more fully explained, the invention may also include a diode placed in parallel circuit to the relay coil and resistors which receive the diverted siren signal when the relay coil is activated. These components prevent electronic interferences such as static or energy spikes from affecting the electronic components within the radio communication and siren systems.

DETAILED DESCRIPTION OF THE INVENTION

Reference is made to the schematic figures for a more detailed description of the invention and its preferred embodiment.

Figure 1:
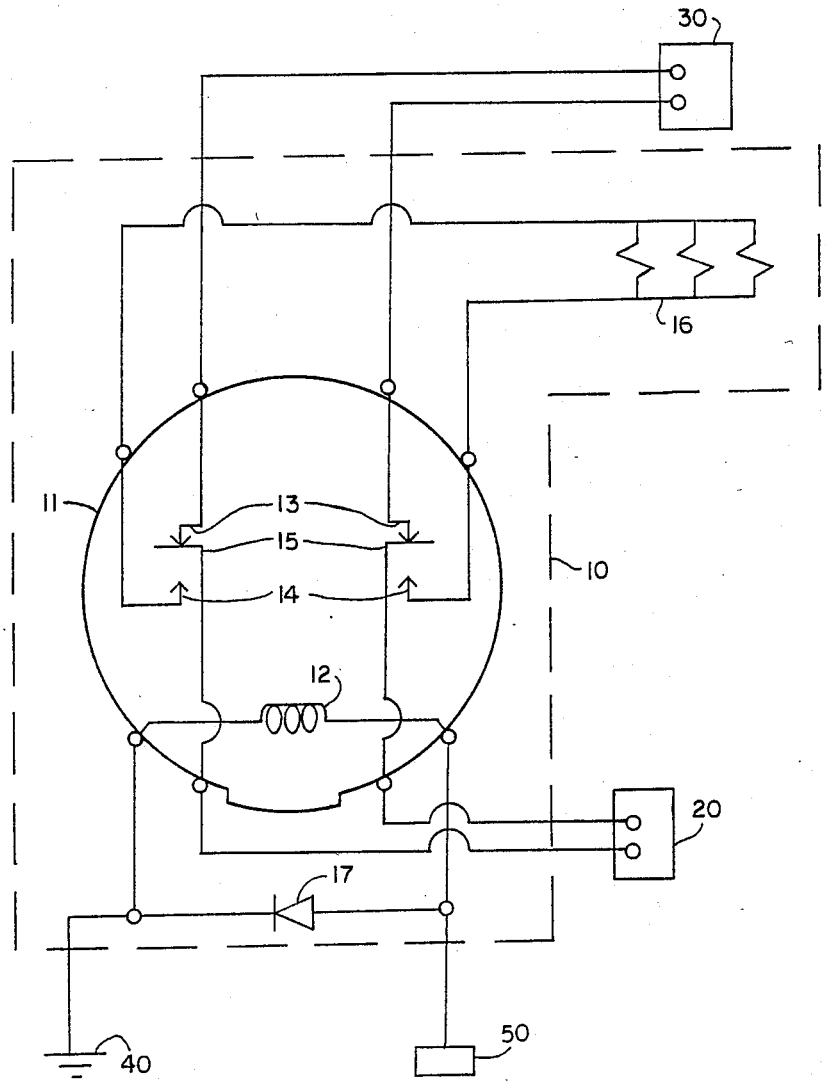
FIG. 1 is a schematic of the invention showing the overall circuitry and the positioning of the contacts in the deactivated state.

As shown in FIG. 1, the invention is an electronic device 10 consisting of several electronic components. The device 10 is attachable to electronic radio communication and siren systems which are currently well-known. A good example of this type of electronic radio communication and siren system is the type commonly used in law enforcement vehicles. In such a system, an audible siren sound is produced by having a direct complete circuit between the siren signal output source 20 and the public address speaker input terminals 30. Independently, the law enforcement officer can transmit over the radio by activating the microphone switch. Activating this switch creates a completed circuit between the microphone and a negative ground 40, allowing the microphone to function.

The device 10 of this invention is attached in the circuit between the siren signal output source 20 and the speaker input terminals 30. The main component of the device 10 is a relay 11 which contains a coil 12 to simultaneously open one set of contacts 13 while closing a second set of contacts 14 when activated. A set of common mobile contacts 15 forms a completed circuit with contacts 13 when the coil 12 is deactivated and a completed circuit with contacts 14 when the coil 12 is activated.

With the device 10 in place, the siren signal is routed from the siren signal output source 20 to the common mobile contacts 15. In the deactivated state, common mobile contacts 15 abut contacts 13. Contacts 13 are connected to the speaker input terminals 30. Therefore, when the coil 12 is not activated, the siren signal proceeds directly from the siren signal output source through contacts 15 and 13 and on to the speaker input terminals 30. When the siren is turned on, the signal reaches the public address speaker without any interference from the device 10 and the audible siren sound is produced.

The purpose of the invention is to interrupt the audible siren sound during any time period that the officer is transmitting over the microphone. The device 10 operates to interrupt the siren signal by breaking the circuit between the siren signal output source 20 and the speaker input terminals 30 whenever the microphone is keyed; i.e., whenever the microphone switch is depressed to create a full circuit to the negative ground 40. The coil 12 is placed in circuit between a positive voltage source 50 and an auxiliary post on the communication unit for negative grounding controlled by the keying of the microphone.

Figure 2:
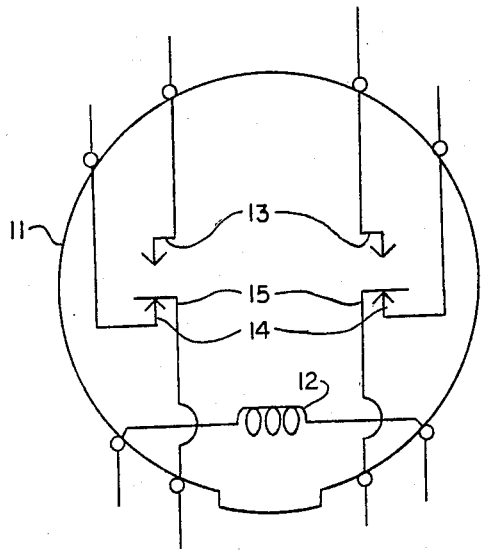
FIG. 2 is a schematic of the relay only, showing the positioning of the contacts in the activated state.

When the microphone is keyed, the circuit between the coil 12 and the negative ground 40 is completed. The coil 12 is activated and opens contacts 15 and 13 while simultaneously closing contacts 15 and 14. The schematic configuration inside relay 11 at this time is shown in FIG. 2. The opening of contacts 15 and 13 means that the siren signal is no longer sent to the speaker input terminals 30, and the audible siren is silenced. The siren signal from the output source 20 is now routed through contacts 15 and 14 to one or more resistors 16. In the case of plural resistors 16, they are placed in parallel.

It is not necessary that resistors 16 be included in the device 11 for it to perform the desired function. It has been found, however, that merely breaking the circuit path from siren signal output source 20 to speaker input terminals 30 without rerouting it through resistors results in electronic interference and causes problems in the components of the overall siren system. By use of resistors 16, no impedence is lost and the apparent performance of the circuit remains the same as if the siren speaker was operating.

When the microphone is unkeyed, the circuit to the negative ground 40 is broken, thereby deactivating the coil 12. This causes contacts 15 and 14 to open while simultaneously closing contacts 15 and 13. The siren signal is now once again routed directly from the output source 20 to the speaker input terminals 30. Upon each successive keying and unkeying of the microphone, the above operations are repeated.

It has been found that the circuit of the coil 12 to the negative microphone ground 40 can cause electronic interference to the radio communications system in the form of energy spikes and static. These problems are solved by the addition of a diode 17 in parallel circuit to the coil 12, as shown in FIG. 1.

The following embodiment of the device has been constructed and field-tested. An Idec RR Heavy Duty relay was mounted to a circuit board. The leads from the relay coil and from a 12 volt Zener diode, in parallel, were connected to two terminal ports. Wires from these two ports were connected to the positive 12 volt source and the auxiliary post of the radio communication microphone. The stationary relay contacts which are closed in the deactivated state were connected to two other terminal ports. Wires from these ports were connected to the public address speaker input terminals. The normally open stationary contacts were connected to a parallel bank of three 50 ohm, 10 watt resistors. The mobile contacts of the relay were connected to two more terminal ports. Wires from these ports were attached to the siren signal output source. The entire device is contained in a housing to protect the components, with only the terminal port wires exposed.

While the device has been above-described as a separate entity able to be attached to existing electronic radio communication and siren systems, it is apparent that the invention claimed herein is in itself an electronic circuit which can be internally incorporated in such systems. The relative simplicity and inexpensiveness of the invention is a primary feature. Those skilled in the art could substitute common components for the specific components enumerated, without departing from the spirit and scope of the invention. The actual scope of the invention is delineated by the following claims.

I claim:

1. A device attached to an electronic communication and siren system, said system having a microphone for voice communication, a siren signal source, an external speaker, a positive voltage source for power, a negative ground controlled by operation of said microphone such that activating the microphone for voice communication completes a circuit to the negative ground, and means to connect auxiliary circuits to said negative ground such that the auxiliary circuits are also controlled by operation of the microphone; the device comprising the following components:

a relay comprising two sets of contacts and a set of mobile contacts, the mobile contacts being connected in circuit to the siren signal source, one set of contacts being connected in circuit to the external speaker, and the other set of contacts being connected in circuit to one or more resistors; where the mobile contacts are controlled by a coil, said coil being connected in an auxiliary circuit between the negative ground and the positive voltage source;

where the coil is activated when a completed circuit is made to the negative ground by operation of the microphone, such that activation of the coil causes the mobile contacts to complete a circuit from the siren signal source through the contacts connected in circuit to the one or more resistors, and further such that non-operation of the microphone deactivates the coil and allows the mobile contacts to complete a circuit from the siren signal source through the contacts connected in circuit to the external speaker;

such that a completed circuit is maintained from the siren signal source to the external speaker, allowing an audible siren sound to be produced, unless the microphone is operated to effect voice communication, such operation causing the siren signal to be routed into the one or more resistors and thereby silencing the siren.

2. The device of claim 1, where the resistors are placed in parallel circuit.

3. The device of claim 1, further comprising a diode placed in parallel circuit to the coil.

4. The device of claim 1, where the device further comprises a housing containing all the components and the circuit connections are effected by leads from terminal ports contained in the housing.

5. The device of claim 2, further comprising a diode placed in parallel circuit to the coil.

6. The device of claim 2, where the device further comprises a housing containing all the components and the circuit connections are effected by leads from terminal ports contained in the housing.

7. The device of claim 3, where the device further comprises a housing containing all the components and the circuit connections are effected by leads from terminal ports contained in the housing.

* * * * *